United States Patent [19]

Kimura et al.

[11] Patent Number: 4,962,008

[45] Date of Patent: Oct. 9, 1990

[54] ELECTROPHOTOGRAPHIC PHOTOSENSITIVE MEMBER

[75] Inventors: Tomohiro Kimura; Yoichi Kawamorita, both of Yokohama, Japan

[73] Assignee: Canon Kabushiki Kaisha, Tokyo, Japan

[21] Appl. No.: 224,825

[22] Filed: Jul. 27, 1988

[30] Foreign Application Priority Data

Jul. 31, 1987 [JP] Japan ..... 62-190184

[51] Int. Cl.[5] ..... G03G 5/14

[52] U.S. Cl. ..... 430/66; 430/57; 430/58; 430/67

[58] Field of Search ..... 430/58, 66, 67, 57

[56] References Cited

U.S. PATENT DOCUMENTS

| | | | |
|---|---|---|---|
| 3,859,090 | 1/1975 | Yoerger et al. | 430/66 X |
| 3,901,700 | 8/1975 | Yoerger et al. | 430/66 X |
| 4,658,756 | 4/1987 | Ito et al. | 430/67 X |
| 4,663,259 | 5/1987 | Fujimura et al. | 430/67 X |
| 4,766,048 | 8/1988 | Hisamura | 430/66 X |
| 4,792,507 | 12/1988 | Yoshihara et al. | 430/58 |

FOREIGN PATENT DOCUMENTS

| | | | |
|---|---|---|---|
| 53-29726 | 3/1978 | Japan | 430/67 |
| 54-3534 | 1/1979 | Japan | 430/66 |
| 62-192754 | 8/1987 | Japan | 430/66 |
| 62-206559 | 9/1987 | Japan | 430/66 |

*Primary Examiner*—Jose Dees
*Assistant Examiner*—Jeffrey A. Lindeman
*Attorney, Agent, or Firm*—Fitzpatrick, Cella, Harper & Scinto

[57] ABSTRACT

An electrophotographic photosensitive member has a photosensitive layer on a conductive substrate, wherein a surface layer of said photosensitive member contains solid lubricant and silicone oil.

13 Claims, No Drawings

ELECTROPHOTOGRAPHIC PHOTOSENSITIVE MEMBER

BACKGROUND OF THE INVENTION

1. Field of the Invention

The present invention relates to an electrophotographic photosensitive member, and more particularly to a highly durable electrophotographic photosensitive member excellent in mechanical strength, surface lubricating property, moisture resistance and imaging performance.

2. Related Background Art

The electrophotographic photosensitive member is required to have suitable sensitivity, electrical properties and optical properties matching the electrophotographic process to be employed. Also in a photosensitive member for repeated use, the surface layer, most distant from the substrate is subjected to electrical and mechanical actions for example in the steps of corona charging, toner development, image transfer to a paper sheet, cleaning process etc. and is required have resistance to such actions. More specifically there are required resistances to surface abrasion or damaging caused by friction, and surface deterioration caused by ozone generated by corona discharge in a high humidity condition.

On the other hand, toner deposition onto the surface layer is induced by the repetition of toner development and cleaning step, and the surface layer is required to have an improved cleaning property.

There have been proposed various methods for achieving these requirements, and one of such methods is the addition of lubricant. However the lubricant tends to migrate to the surface, so that the coated film becomes rich in the lubricant at the surface. Thus the photosensitive member shows good mechanical properties in the beginning, but soon loses said properties as the surface portion containing the lubricant is abraded off.

Another method consists of dispersing solid lubricant, particularly powdered fluorinated resin, in the surface layer of the photosensitive member, as disclosed in the Japanese Patent Laid-open Application No. 57-74748 and the U.S. Pat. Nos. 4,030,921 and 4,663,259. The dispersion of powdered fluorinated resin improves the resistances to surface damaging, surface cleaning and abrasion, and is effective also for surface deterioration under high humidity as it also improves the water-repellent property and releasing property of the surface of the photosensitive member. Also a protective layer containing powdered fluorinated resin dispersed therein further improves the durability, as the charge transporting material and the charge generating material, which are easily subjected to deterioration by ozone, are separated from the surface of the photosensitive member.

However, if the surface layer of the photosensitive member is formed by a coated film obtained by coating a liquid in which the powdered fluorinated resin is dispersed, said powdered resin is not exposed to the surface of thus formed coated film, and said surface is composed of the binder resin. Consequently the effect of the dispersed fluorinated resin cannot be seen in the beginning period of the use. As the result there are encountered various troubles such as the fusion of the surface of the photosensitive member and the cleaning blade, and the damage of said surface caused by the cleaning blade. For avoiding such troubles it is necessary to sprinkle toner or powdered lubricant on said surface or to intentionally scrape the surface off, and such operation inevitably raises the cost on the point of the required facility and labor.

SUMMARY OF THE INVENTION

The object of the present invention is to prevent the drawbacks of the conventional technology explained above, to provide an electrophotographic photosensitive member having lubricating property from the beginning of use and capable of maintaining the resistances to surface abrasion and damaging by friction and to moisture, and to provide an electrophotographic photosensitive member having high image quality and particularly high sensitivity in the repeated use.

As the result of investigation made toward such objectives, the present inventors have reached an electrophotographic photosensitive member capable of resolving the above-mentioned drawbacks and showing excellent electrophotographic properties.

To be more specific, the present invention provides an electrophotographic photosensitive member having a photosensitive layer on a conductive substrate, comprising solid lubricant and silicone oil in the surface layer of the photosensitive member.

DETAILED DESCRIPTION OF THE INVENTION

Examples of the solid lubricant to be employed in the present invention include powdered lubricating resins such as powdered fluorinated resins, powdered polyolefinal resins and powdered silicone resins, among which preferred are powdered fluorinated resins in consideration of the lubricating property. As the powdered fluorinated resin there may be suitably employed polymers and copolymers of tetrafluoroethylene, trifluorochloroethylene, hexafluoroethylenepropylene, vinyl fluoride, vinylidene fluoride, difluorochloroethylene or trifluoropropylmethylsilane.

Particularly preferred are tetrafluoroethylene resin, vinylidene fluoride resin, and copolymer of tetrafluoroethylene and hexafluoropropylene.

The molecular weight and particle size of resin can be suitably selected, but preferably the average particle size is in a range from 0.1 to 10 $\mu$m, and the molecular weight does not exceed 1,000,000.

The powdered fluorinated resin is advantageously added in an amount of 1 to 50% of the solid weight of the layer into which said resin is to be dispersed.

In the present invention, it is also effective, in order to improve the dispersibility of the powdered fluorinated resin, to add a small amount of surfactant, coupling agent, levelling agent or fluorinated graft polymer as proposed by the present applicant in the Japanese Patent Applications No. 61-58153 and 62-54096, as a dispersion accelerator.

The silicone oil to be employed in the present invention has a linear siloxane structure represented by the following general formula:

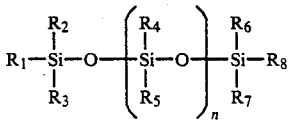

wherein $R_1$, $R_2$, $R_3$, $R_4$, $R_5$, $R_6$, $R_7$ and $R_8$ are respectively an alkyl radical such as methyl or ethyl, an aryl radical such as phenyl or naphthyl, or an alkoxy radical such as methoxy or ethoxy, an allyl radical such as vinyl, a halogen radical such as chlorine or fluorine, or hydrogen atom, which may be substituted with another substituent or a halogen atom. n is a positive integer indicating the average degree of polymerization.

The following are examples of silicone oil.

1.

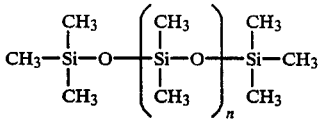

2.

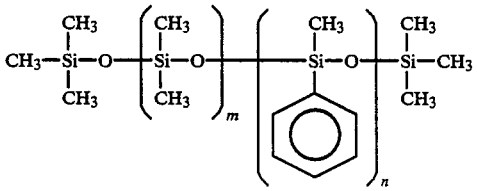

3.

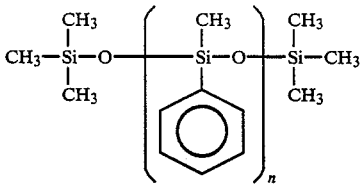

4.

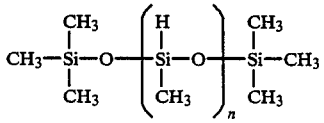

5.

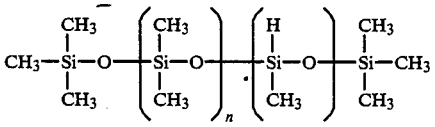

6.

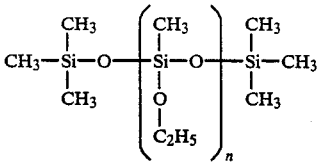

7.

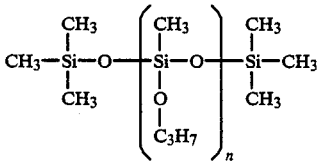

8.

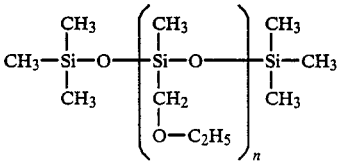

-continued

9.

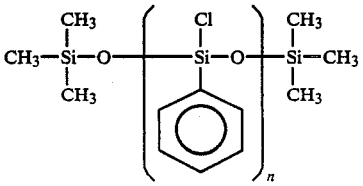

10.

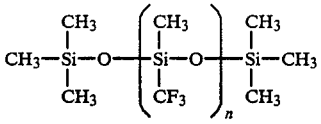

11.

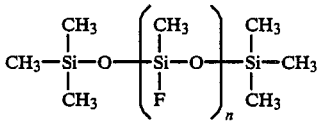

12.

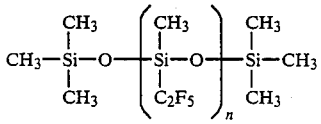

13.

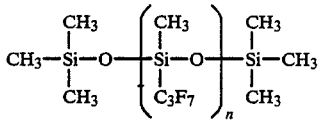

14.

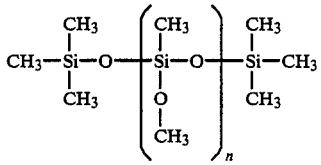

15.

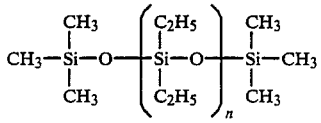

16.

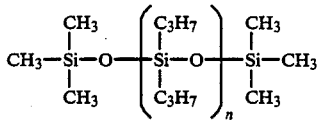

17.

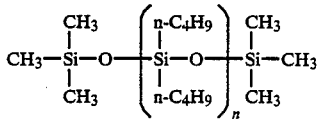

18.

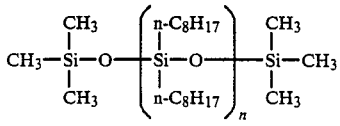

-continued
19.
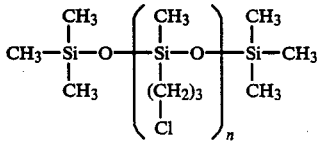
20.
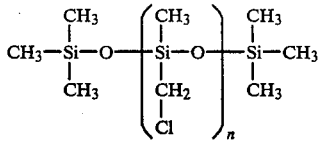
21.
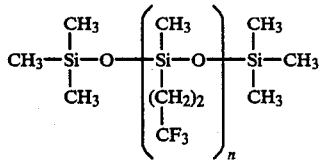
22.
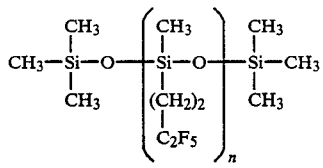
23.
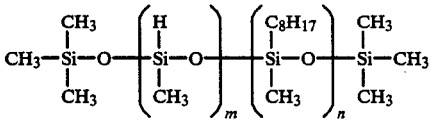
24.
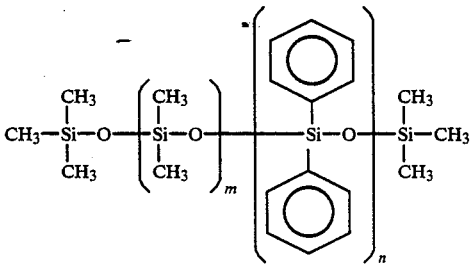
25.
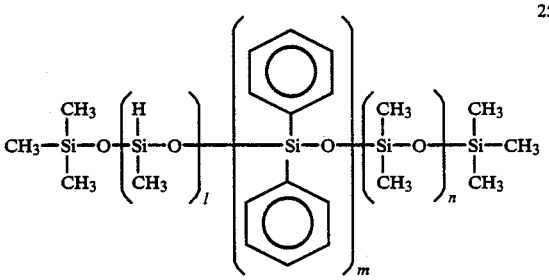
26.
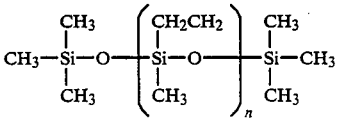
-continued
27.
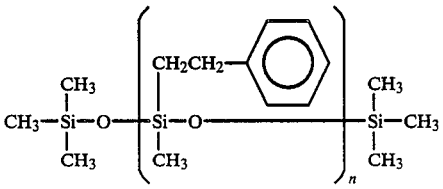
28.
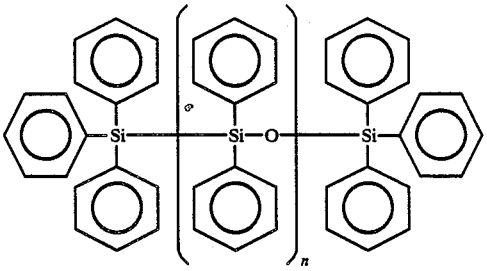
29.
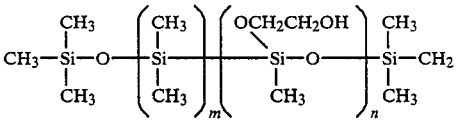
30.
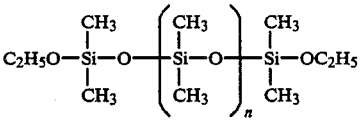
31.
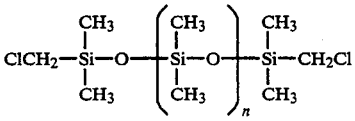
32.
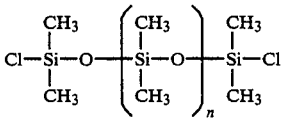
33.
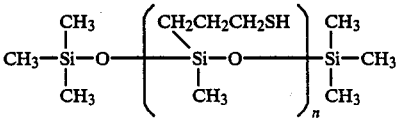
34.
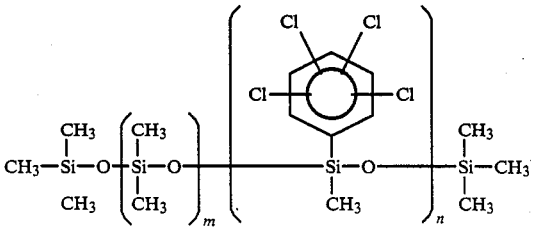

-continued

35.

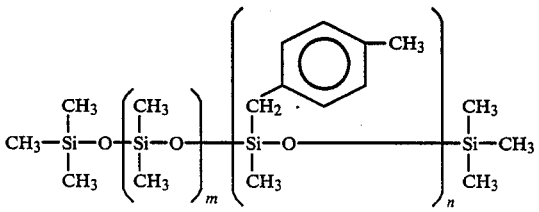

The silicone oil is added in an amount of 10 to 1,000 ppm, preferably 25 to 100 ppm, with respect to the solid weight of the surface layer.

An amount less than 10 ppm does not provide sufficient improvement of the surface properties, while an amount exceeding 1,000 ppm gives rise to undesirable effects such as a lowered sensitivity resulting from an increased retentive potential.

The combined use of the solid lubricant and the silicone oil allows to constantly maintain the lubrication of the surface of the photosensitive member, by means of the silicone oil present at said surface in the early stage of the use of said photosensitive member and by means of the solid lubricant dispersed in the layer after the surface is abraded, thereby realizing satisfactory electrophotographic characteristics constantly from the beginning of the use.

The surface layer of the photosensitive member of the present invention is a charge transport layer if the photosensitive member is composed of a photosensitive layer formed on a conductive substrate and if said photosensitive layer is composed of a charge generation layer and a charge transport layer formed thereon. Said surface layer is a charge generation layer if it is formed on the charge transport layer, or, it is a unified photosensitive layer if the photosensitive layer has a unified layer structure containing a charge generating material and a charge transporting material therein. Also said surface layer is a protective layer if a protective layer is formed on such photosensitive layer.

The photoconductive material to be employed in said photosensitive layer is preferably an organic photoconductor.

The binder resin to be employed in the present invention can be composed of polymer with film forming property, but preferably polymethacrylate ester, polycarbonate, polyallylate, polyester, polysulfone, polystyrene, styrene-methacrylate ester copolymer etc. in consideration of a face that it should singly have a certain hardness and it should not hinder the transportation of carriers.

The conductive substrate can be composed of a conductive material such as aluminum, aluminum alloys or stainless steel; a plastic material with a vacuum evaporated layer of aluminum, aluminum alloy, indium oxide, tin oxide, indium oxide-tin oxide alloy etc.; or a conductive or plastic material on which a resin film, containing conductive particles such as titanium oxide or tin oxide dispersed therein, is formed by coating.

Between the conductive substrate and the photosensitive layer, there may be provided a subbing layer having a barrier function and an adhering function. Such subbing layer may be composed of casein, polyvinyl alcohol, nitrocellulose, ethylene-acrylic acid copolymer, polyamide (nylon-6, nylon-66, nylon-610, copolymerized nylon, alkoxymethylated nylon etc.), polyurethane, gelatin or aluminum oxide.

The thickness of subbing layer is in a range from 0.1 to 5 μm, preferably 0.5 to 3 μm.

Examples of the charge generating material include pyrilium and thiopyrilium dyes, phthalocyanine pigments, anthanthrone pigments, dibenzpyrenequinone pigments, pyranthrone pigments, trisazo pigments, disazo pigments, azo pigments, indigo pigments, quinacridone pigments, asymmetric quinocyanines, and quinocyanines.

Examples of the charge transporting material include fluorenone type compounds, carbazole type compounds, hydrazone type compounds, pyrazoline type compounds, styryl type compounds, oxazole type compounds, thiazole type compounds, triarylmethane type compounds and polyarylalkane type compounds.

In the following there will be explained the method of producing the photosensitive member of the present invention, in case of a function-separated photosensitive member in which a charge transport layer is laminated on a charge generation layer.

The above-mentioned charge generating material is dispersed in binder resin of an amount of 0.3 to 10 times and a solvent, by means for example of homogenizer, ultrasonic wave, ball bill, vibrated ball mill, sand mill, Attriter or roll mill. The obtained dispersion is coated and dried, on a substrate having the above-mentioned subbing layer, to obtained a coated film of a thickness of 0.1 to 1 μm.

The charge transport layer is formed by dissolving the above-mentioned charge transporting material and a binder resin in a solvent, dispersing powdered fluorinated resin therein, and coating the obtained liquid on said charge generation layer. The mixing ratio of the charge transporting material and the binder resin is generally in a range from 2:1 to 1:2. There is employed a solvent or a mixture of plural solvents capable of dissolving the binder resin.

The powdered fluorinated resin can be easily and uniformly dispersed, with the above-mentioned solvent, for example in a homogenizer, a ball mill, a sand mill, an attritor, a roll mill or a colloid mill.

The silicone graft polymer may be added either before or after the dispersion.

The coating can be achieved by dip coating, spray coating, spinner coating, bead coating, Meyer bar coating, blade coating, roller coating or curtain coating. The obtained coating is preferably dried at room temperature until touch dry, followed by heating. The drying under heating can be conducted for a period of 5 to 120 minutes at a temperature of 30° to 200° C., under still or fed air.

The final thickness of the charge transport layer is generally in a range of 5 to 30 μm.

EXAMPLE 1

On an aluminum cylindrical substrate of a diameter of 80 mmϕ and a length of 320 mm, 5% methanol solution of polyamide (Amilan CM-8000 supplied by Toray K.K.) was dip coated to obtain a subbing layer of a thickness of 1 μm.

10 parts (hereinafter by weight) of a disazo pigment of the following structure as the charge generating material;

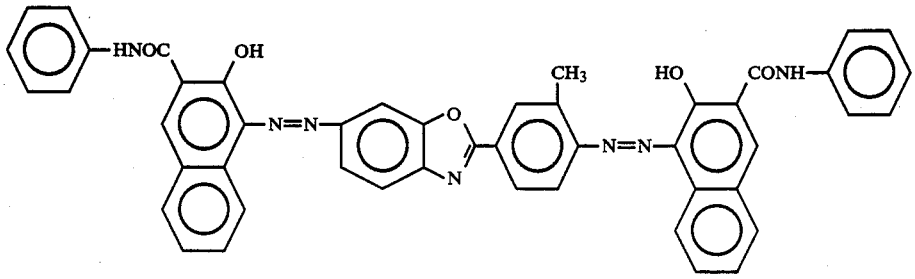

8 parts of polyvinyl butyral (known under a trade name S-LEC BXL, supplied by Sekisui Chemical K.K.) and 50 parts of cyclohexanone were dispersed for 20 hours in a sand mill utilizing glass beads of 1 mmϕ. The obtained dispersion was added with 70 to 120 parts of methylethylketone, and was coated on the subbing layer to obtain a charge generation layer of a thickness of 0.15 μm.

Separately 10 parts of polymethyl methacrylate (average molecular weight 150,000), and 5 parts of powdered polytetrafluoroethylene as the powdered fluorinated resin (trade name Lubron L-2 supplied by Daikin Kogyo K.K.) were dispersed with 40 parts of monochlorobenzene and 15 parts of THF for 50 hours in a stainless steel ball mill. Coating liquid for the charge transport layer was prepared by dissolving 10 parts of p-diethylaminobenzaldehyde-N-β-naphthyl-N-phenylhydrazone as the charge transporting material in the above-obtained dispersion, and then adding dimethylpolysiloxane-polyoxyalkylene copolymer of the following formula:

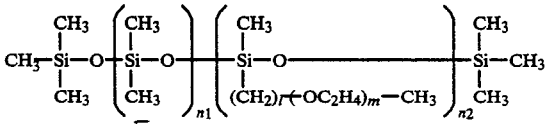

wherein l, m, $n_1$ and $n_2$ are positive integers and preferably l is 3, m 5, $n_1$ 30 and $n_2$ 20, as the silicone oil in an amount of 100 ppm with respect to the total weight of polymethyl methacrylate, polytetrafluoroethylene and charge transporting material.

Said coating liquid was coated on the charge generation layer and dried for 1 hour with hot air of 100° C. to obtain a charge transport layer of 19 μm in thickness. Sample 1 was obtained in this manner.

Sample 2 was prepared in the same process as in sample 1, except that the charge transport layer was prepared with coating liquid not containing the silicone oil.

The friction coefficient of the surface of said samples 1, 2 was compared as follows, as the ratio to the friction coefficient of a polyethylene terephthalate film:

Sample 1/polyethylene terephthalate = 1.20

Sample 2/polyethylene terephthalate = 6.08

Thus the friction coefficient of sample 1 is about 1/6 of that of sample 2.

Then samples 1 and 2 were subjected to image formation by an electrophotographic process consisting of a corona charging of −5.5 kV, an image exposure, a dry toner development, an image transfer to plain paper and a cleaning step with an urethane rubber blade, and sample 1 provided an image of high quality without defects such as black streaks. On the other hand sample 2 could not provide satisfactory image due to the damage on the drum surface, caused by a blade inversion.

Sample 3 was prepared with a drum coated up to the charge generation layer in the same manner as in sample 1. Coating liquid obtained by dissolving 10 parts of polymethyl methacrylate, 10 parts of the abovementioned charge transporting material and the silicone oil used in sample 1 in an amount of 100 ppm with respect to the total weight of polymethyl methacrylate and charge transporting material in a mixed solvent consisting of 40 parts of monochlorobenzene and 15 parts of THF was coated and dried on said drum to obtain a charge transport layer of 19 μm in thickness, thereby completing sample 3.

Samples 1 and 3 were subjected to the comparison of durability by 30,000 continuous image formations in the above-explained electrophotographic process. The obtained results are shown below.

The image evaluation in the present invention was conducted by forming images with a halftone original and a white background original with 7% image area at every 1000 sheets under a condition of 23° C. and 55% R.H. or every 100 sheets under a condition of 32.5° C. and 90% R.H., and visually inspecting the obtained images for black streaks resulting from frictional damages and background smear resulting from the surface scraping of the photosensitive member.

| Sample | 23° C., 55% R.H. | 32° C., 90% R.H. |
|---|---|---|
| 1 | High image quality was stable up to 30,000 th copy, without black streak or background fogged image | same as left |
| 3 | One black streak observed at 7,000 th copy | same as left |

EXAMPLE 2

The process of the example 1 was reproduced except that the powdered fluorinated resin was replaced by polyvinylidene fluoride (trade name Kynar K-301 supplied by Pennwalt Inc.) and the silicone oil of the following formula:

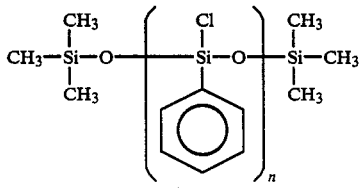

wherein n is a positive integer and preferably n is 50, was employed, and similar results as in the example 1 could be obtained. The friction coefficient was 1:1.15.

EXAMPLE 3

An aluminum cylindrical substrate of a diameter of 80 mmϕ and a length of 320 mm was dip coated with 5% methanol solution of polyamide mentioned above to obtain a subbing layer of 0.5 μm in thickness.

12 parts of a pyrazoline compound of the following formula as the charge transporting material:

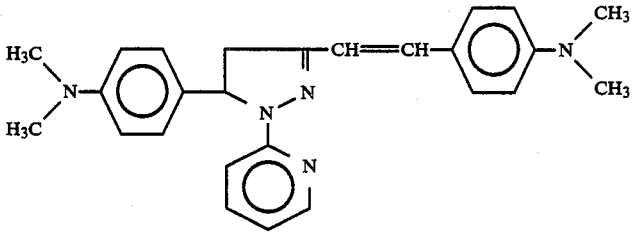

10 parts of bisphenol-A type polycarbonate (trade name Iupilon S-2000 supplied by Mitsubishi Gas Chemical K.K.) were dissolved in a mixed solvent of dioxane and dichloromethane.

The obtained liquid was dip coated on the subbing layer and dried for 1 hour with hot air of 100° C. to obtain a charge transport layer of 17 μm in thickness.

Separately 10 parts of a disazo pigment of the following formula as the charge generating material:

5 parts of powdered polytetrafluoroethylene, and fluorinated graft polymer (trade name Alon GF-300 supplied by Toa Gosei Kagaku K.K.) as the dispersion accelerator in an amount of 5% with respect to the solid weight of polytetrafluoroethylene, were added in 100 parts of solution of bisphenol-Z type polycarbonate (supplied by Mitsubishi Gas Chemical K.K.) in cyclohexanone, and dispersed for 48 hours in a stainless ball mill. After the dispersion 10 parts of the charge transporting material employed in the example 1 were added to the dispersion, and silicone oil of the following formula:

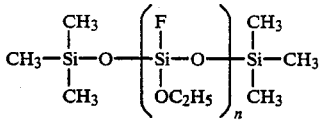

wherein n is a positive integer and preferably n is 30, was added in an amount of 200 ppm with respect to the total weight of polycarbonate, disazo pigment, charge transporting material and powdered polytetrafluoroethylene.

The liquid obtained after addition was dip coated on the charge transport layer, and dried for 20 minutes at 100° C. to obtain a charge generation layer of 3 μm in thickness. Sample 4 was prepared in this manner.

Also sample 5 was prepared in the same manner as sample 4, but with a charge generation layer not containing silicone oil.

The friction coefficient of samples 4 and 5 was evaluated as in example 1, as the ratio to the friction coefficient of polyethylene terephthalate, as shown in the following:

Sample 4/polyethylene terephthalate=0.91

Sample 5/polyethylene terephthalate=6.20

Then the samples 4 and 5 were subjected to image formation by an electrophotographic process consisting of a corona charging of +5.5 kV, an image exposure, a dry toner development, an image transfer to plain paper and a cleaning step with an urethan rubber blade, and sample 4 provided an image of high quality without defects such as black streaks. On the other hand sample 5 could not provide satisfactory image due to the damage on the drum surface caused by blade inversion, because of insufficient surface lubrication.

Then samples 4 and 5 were subjected to continuous image formations of 10,000 sheets by the above-explained electrophotographic process. The results are shown in the following:

| Sample | 23° C., 55% R.H. | 32° C., 90% R.H. |
|---|---|---|
| 4 | Image uniform until 10,000 th sheet without black streak or background fogged image | Same as left |
| 5 | A black streak observed at 2,000 th copy; three black streaks observed, also fog observed in the white background due to scraping of charge generation layer, at 5,000 th copy | A black streak observed at 2,300 th copy; fog on white background observed at 5,500 th copy; toner fusion observed at 1,000 th copy. |

EXAMPLE 4

An aluminum cylindrical substrate of a diameter of 80 mmϕ and a length of 360 mm was dip coated with 5% methanol solution of the aforementioned polyamide to obtain a subbing layer of 1 μm in thickness.

1 part of aluminum chloride phthalocyanine as the charge generating material, 10 parts of the aforementioned bisphenol-Z type polycarbonate, 60 parts of cyclohexanone, 15 parts of cyclohexane and 4 parts of powdered polyvinylidene fluoride were mixed and dispersed for 48 hours in a stainless steel ball mill. The obtained dispersion was added with 6 parts of p-diethylaminobenzaldehyde-N-β-naphthyl-N-phenylhydrazone as the charge transporting material and silicone oil of the following formula:

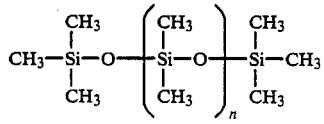

wherein n is a positive integer and preferably n is 100, in an amount of 300 ppm with respect to the solid weight.

The obtained liquid was dip coated on the subbing layer to obtain a photosensitive layer of 20 μm in thickness. Sample 6 was prepared in this manner.

Sample 7 was prepared in the same manner as sample 6, but without the silicone oil.

Also sample 8 was prepared with coating liquid not containing powdered polyvinylidene fluoride.

Thus sample 6 contains both polyvinylidene fluoride and silicone oil, while sample 7 contains powdered polyvinylidene fluoride only, and sample 8 contains silicone oil only.

Comparison of the friction coefficient of samples 6, 7, 8 as in the example 1 provided following results:

Sample 6/polyethylene terephthalate=0.85

Sample 7/polyethylene terephthalate=5.95

Sample 8/polyethylene terephthalate=0.85

Then samples 6, 7, 8 were subjected to continuous image formations of 50,000 sheets under a condition of 23° C., 55% R.H. or 32.5° C., 90% R.H. in a plain paper electrophotographic copying machine effecting steps of a corona charging of −5.5 kV, an image exposure, a dry toner development, an image transfer to ordinary paper, and a cleaning step with an urethane rubber blade. The results are shown in the following:

| Sample | 23° C., 55% R.H. | 32° C., 90% R.H. |
|---|---|---|
| 6 | Satisfactory uniform images up to 50,000 th copy, without black streak or background fogged image | Same as left |
| 7 | Test interrupted because satisfactory image could not be obtained due to surface damages caused by blade inversion | Same as left |
| 8 | Black streaks observed at 15,000 th copy. At 50,000 th copy, four black streak observed. Also black density decrease and fog in white background observed due to scraping. | Same as left<br>Toner fusion observed at 1,500 th copy |

We claim:

1. An electrophotographic photosensitive member having a conductive substrate; a photosensitive layer on said conductive substrate and a surface layer of said photosensitive member containing solid lubricant and silicone oil, wherein the content of the silicone oil is from 10 to 1000 ppm based on the total solids of the surface layer.

2. An electrophotographic photosensitive member according to claim 1, wherein said solid lubricant is selected from a group consisting of powdered fluorinated resins, powdered polyolefin resins, and powdered silicone resins.

3. An electrophotographic photosensitive member according to claim 1, wherein said solid lubricant is powdered fluorinated resin.

4. An electrophotographic photosensitive member according to claim 3, wherein said powdered fluorinated resin is selected from a group consisting of tetrafluoroethylene resins, vinylidene fluoride resins, and tetrafluoroethylene-hexafluoropropylene copolymer resins.

5. An electrophotographic photosensitive member according to claim 1 or 3, wherein said solid lubricant is added with an amount within a range of 1 to 50 wt.% with respect to the solid weight of the surface layer.

6. An electrophotographic photosensitive member according to claim 1, wherein the silicone oil has a linear siloxane structure represented by the following general formula:

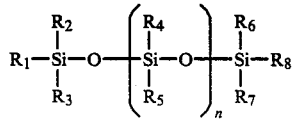

wherein $R_1$, $R_2$, $R_3$, $R_4$, $R_5$, $R_6$, $R_7$ and $R_8$ are respectively an alkyl radical, aryl radical, allyl radical, alkoxy radical, halogen atom or hydrogen atom that may be substituted, and n is a positive integer indicating the average degree of polymerization.

7. An electrophotographic photosensitive member according to claim 1, wherein the photoconductive material in the photosensitive layer is an organic photoconductive material.

8. An electrophotographic photosensitive member according to claim 1, wherein the photosensitive layer is composed of a laminate structure of a charge generation layer and a charge transport layer.

9. An electrophotographic photosensitive member according to claim 8, wherein said charge transport layer is formed on said charge generation layer.

10. An electrophotographic photosensitive member according to claim 1, wherein said photosensitive layer is composed of a single layer.

11. An electrophotographic photosensitive member according to claim 7, wherein said photosensitive layer is composed of a single layer.

12. An electrophotographic photosensitive member according to claim 1, wherein the surface layer is the photosensitive layer.

13. An electrophotographic photosensitive member according to claim 1, wherein the surface layer is a protective layer.

* * * * *

UNITED STATES PATENT AND TRADEMARK OFFICE

CERTIFICATE OF CORRECTION

PATENT NO. : 4,962,008

DATED : October 9, 1990

INVENTOR(S) : Tomohiro Kimura, et. al.

It is certified that error appears in the above-identified patent and that said Letters Patent is hereby corrected as shown below:

Column 2, line 33, "polyolefinal" should read --Polyolefin--.

COLUMN 8

Line 28, "Attriter" should read --attriter--.

COLUMN 11

Line 32, "charge generating material:" should read --charge generating material:

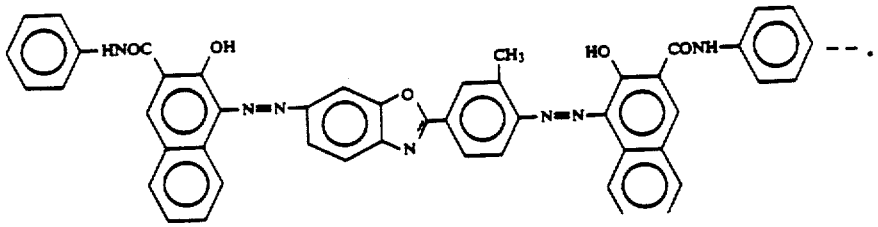

--.

Signed and Sealed this

First Day of September, 1992

*Attest:*

DOUGLAS B. COMER

*Attesting Officer*

*Acting Commissioner of Patents and Trademarks*